US005694647A

United States Patent [19]

Crickmore

[11] Patent Number: 5,694,647

[45] Date of Patent: Dec. 9, 1997

[54] WEATHER-SHIELDING ACCESSORY FOR HEADGEAR

[76] Inventor: Ingrid C. Crickmore, Morning Glory Preschool, 6614 Dover St., Oakland, Calif. 94609

[21] Appl. No.: 293,665

[22] Filed: Aug. 22, 1994

[51] Int. Cl.[6] ..... A42B 1/06

[52] U.S. Cl. ..... 2/172; 2/10; 2/175.3; 2/175.6; 2/183; 2/207; 2/209.13

[58] Field of Search ..... 2/10, 12, 15, 171, 2/172, 174, 175.3, 175.6, 183, 184.5, 207, 209.13, 209.3, 209.4, 209.7; D2/865, 866, 872, 873, 874, 876, 877, 879, 880, 881, 882, 884, 886, 891, 893

[56] References Cited

U.S. PATENT DOCUMENTS

| | | | |
|---|---|---|---|
| D. 340,344 | 10/1993 | McPherson | D2/866 |
| 986,728 | 1/1911 | Lee . | |
| 1,163,287 | 12/1915 | Van Raalte | 2/207 |
| 1,283,357 | 10/1918 | Thompson | D2/877 |
| 2,005,361 | 5/1935 | Rollins et al. | 2/198 |
| 2,698,944 | 1/1955 | Ramsby | 2/174 |
| 2,767,404 | 3/1956 | Collins | 2/198 |
| 3,016,545 | 2/1962 | Donahue | 2/199 |
| 3,235,882 | 2/1966 | Coleman | 2/174 |
| 4,980,928 | 1/1991 | Ellis | 2/88 |
| 5,048,128 | 9/1991 | Watson, Jr. | 2/204 |
| 5,081,717 | 1/1992 | Shedd et al. | 2/199 |
| 5,083,317 | 1/1992 | DeMoreta | 2/174 |
| 5,121,507 | 6/1992 | Brown | 2/199 |
| 5,153,943 | 10/1992 | Clement | 2/199 |
| 5,251,336 | 10/1993 | Nevins | 2/84 |
| 5,293,646 | 3/1994 | Winston | 2/207 |

OTHER PUBLICATIONS

Yarwood, Doreen: Encylcopedia of World Costume, ©1978, p. 259 (Arabic "Kaffiyeh").

Thompson, Leroy: Uniforms Of The Soldiers Of Fortune, ©1985 Plates 24 (FIG. 71) and 29 (FIG. 87), pp. 138–139, 152–153.

Mollo, Andrew: Army Uniforms Of World War 2, ©1973 p. 178 and plate 199.

*Primary Examiner*—Diana Biefeld

[57] ABSTRACT

A flexible weather-shield accessory that can be attached to any headgear, or in the absence of other headgear, that can be worn by itself on a user's head. The accessory has a body portion capable of shielding the wearer's neck and ears. This body portion includes a visor-covering area that can lie across the visor or forward extension of the brim of a hat, extending coverage forward of the wearer's face. Thus the accessory is also capable of shielding the sides of the face, including nose and chin. The accessory has an inner opening with a size-adjustment mechanism that allows for the insertion of, and releasable attachment onto, the crown of a hat, cap, or head. It can adjust to fit onto any size head or hat. Fasteners are located at the front lower edge of the accessory to enable the accessory to be loosely closed together below the chin and neck of the wearer, and alternatively, to allow the accessory to be fastened to the upper button and buttonhole of the wearer's shirt or blouse. The accessory can also be tied under the chin in the manner of a scarf.

21 Claims, 5 Drawing Sheets

Fig. 1
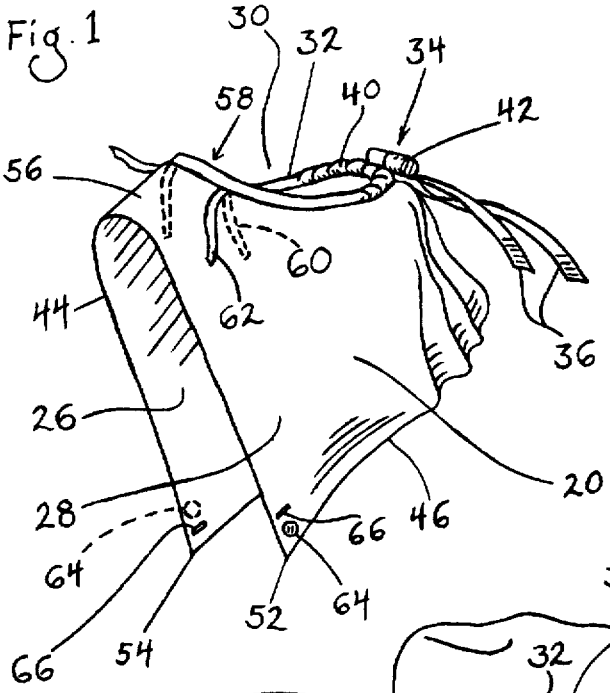
Fig. 7
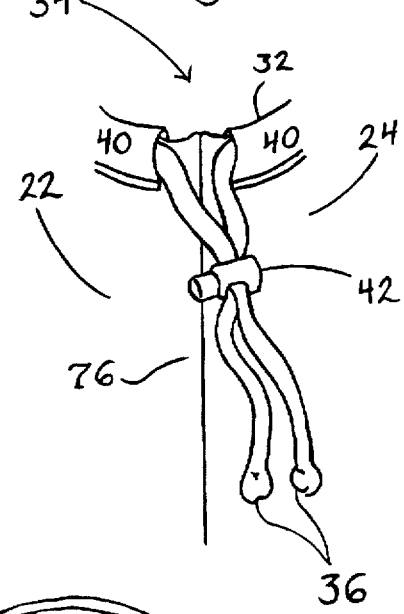
Fig. 2
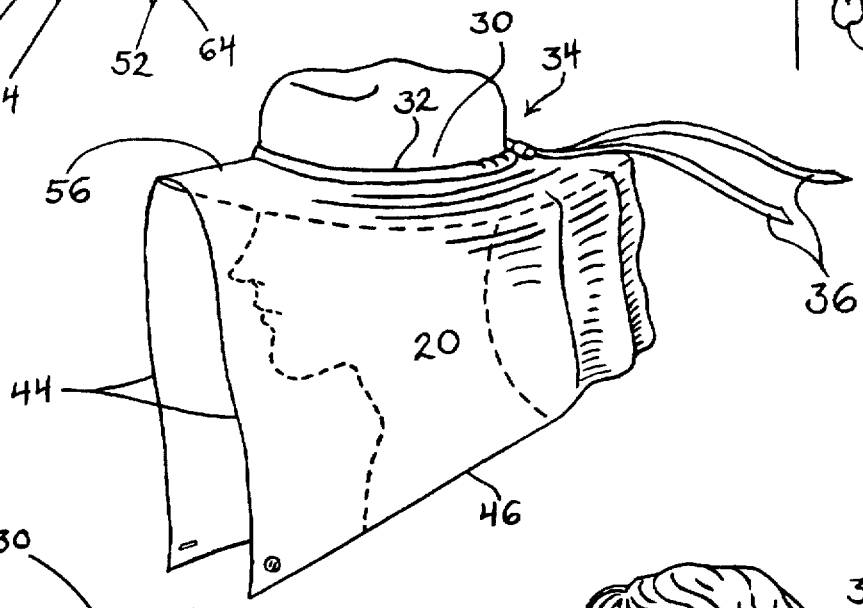
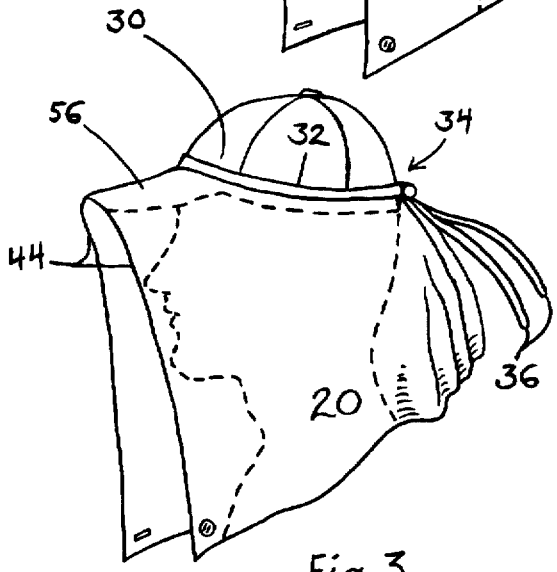
Fig. 3
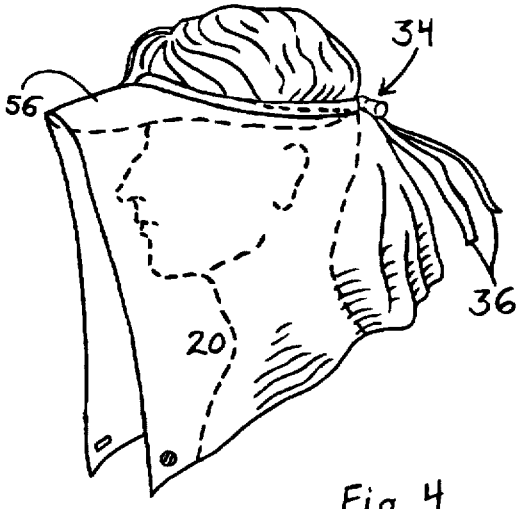
Fig. 4

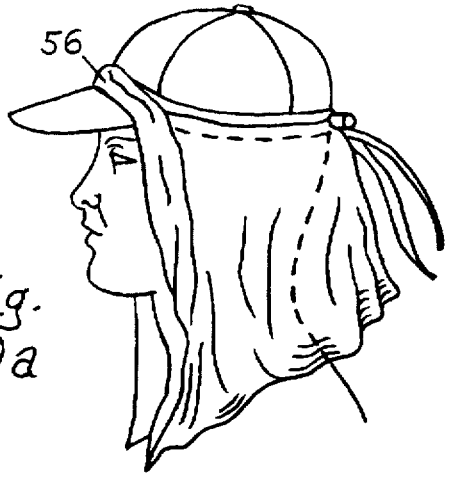
Fig. 10a
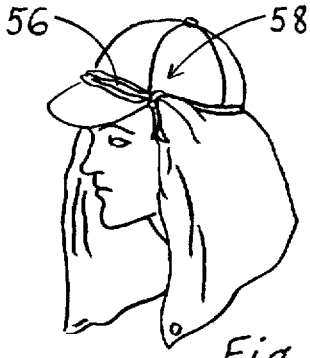
Fig 10b
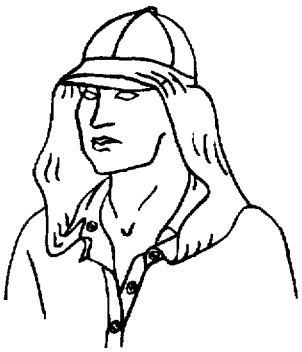
Fig. 10c
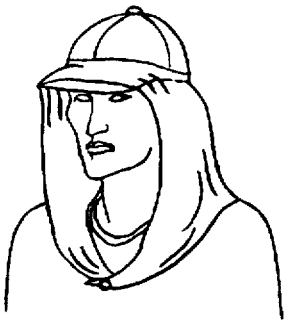
Fig. 10d
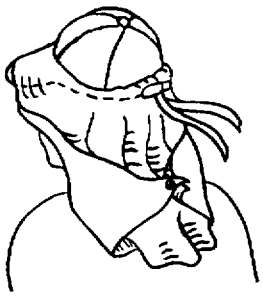
Fig 10e
Fig. 10f
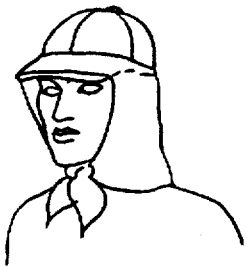
Fig. 10g
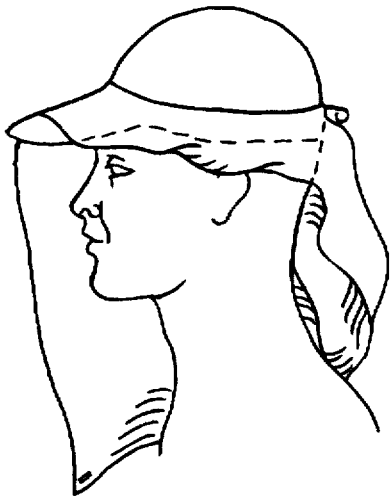

WEATHER-SHIELDING ACCESSORY FOR HEADGEAR

BACKGROUND—FIELD OF INVENTION

This invention relates to hat accessories, specifically those that serve to increase the weather-shielding capability of a hat, cap, or visor.

BACKGROUND—DESCRIPTION OF PRIOR ART

Hats have been worn for millennia to protect the wearer's head from sun, wind, rain, and cold. Scarves and scarf-like articles of apparel have been worn for these same reasons.

One major shortcoming of brimmed hats and caps is that, while providing generally good sun protection while the sun is directly overhead, they provide little or no protection to the face, ears, and neck when the sun is not directly overhead. They also provide no protection to these areas from wind and cold. The only historical precedent for headgear that truly protects most of the face from the sun is the poke-bonnet, worn by pioneer women in this country in the eighteen-hundreds. However, the poke-bonnet is unwieldy, hard to care for (it must be starched to stand stiffly out in front of the face), blows around in wind, was restricted to women, and is now hopelessly out of fashion. Furthermore, it did not protect the lower areas of the neck, and often exposed the chin and part of the jaw.

Scarves and similar articles—the arabic "kaffiyah", for example—do protect the ears and neck, but they do not protect the face from oblique or even overhead sunlight.

Field workers and desert hikers commonly wear a bandana under their hats that hangs down over part of the face and neck, effecting a partial shield for these areas. As the bandana covers the crown of the head and hangs closely against the skin, it tends to make the wearer hotter and sweatier. It does not extend forward of the cheekbones, and it blows back very easily, exposing ears and sides of neck.

Hats have been made with dependent ear and neck flaps, either permanent or detachable, but none of these have protected facial areas forward of the cheekbones, including nose, chin, much of cheeks and jaw.

Another problem with flapped hats and caps—even those with removable flaps, like the Japanese WWII field cap and some present-day hiking caps–is that they are seen as "specialty items" and are not likely to be worn in an every-day way, even when over-exposure to the sun is a perceived problem. Most people choose a hat for complex reasons, including aesthetics and group identification, as well as sun protection. They are unlikely to buy and carry around a second specialized, odd-looking, and expensive hat to augment their primary one.

A few hat-accessories have been made or described which can be attached to the wearer's primary hat or cap for added protection, and removed when not needed. However these all have cumbersome and time-consuming methods of affixation, reducing their ease of use. Additionally, none of them provide protection to forward areas of the face.

In the Spanish Foreign Legion a modified kaffiyah, known as a "siroquera" has been worn over a brimmed utility cap in the Sahara desert. The siroquera is wrapped and tucked over the crown of the cap and hangs down the back and sides of the wearer's head, being held in place by a pair of sand goggles strapped around either the wearer's eyes or the crown of the hat and encircling the back of the head. Thus the siroquera is complex and cumbersome to remove and replace, as well as adding unnecessary warmth and bulk over the top of the head. Furthermore, it does not utilize the visor portion of the cap to extend coverage forward of the cheekbones. Thus the forward areas of the face remain unprotected.

Sheddet al. (U.S. Pat. No. 5,081,717, issued Jan. 1, 1992) and Brown (U.S. Pat. No. 5,121,507, issued Jun. 16, 1992) both teach neck- and ear-guard accessories that must be clipped onto the headgear with three clips. Thus at least three separate operations are required for attachment, or even more, as the hat would probably have to be removed from the head during this process. Brown's accessory (U.S. Pat. No. 5,121,507) has a secondary releasable attachment device composed of a Velcro hook and loop to fastening strip around the upper periphery of the accessory that allows the shield portion to be pulled off and replaced onto the clipped-on portion. However, this leaves an unsightly Velcro strip clipped all the way around the periphery of the headgear. Velcro hook and loop fasteners have the added disadvantage of easily catching and entangling long or curly hair. There is also a danger of hair becoming caught and entangled in the clips of both these accessories. Again, neither of these accessories protects the face.

Clement (U.S. Pat. No. 5,153,943, issued Oct. 13, 1992) teaches a hat accessory that fits onto only those baseball-style caps and hardhats that have a rear size-adjustment strap. This in itself is a significant limitation, especially for women, who are less likely than men to wear baseball caps or hardhats. The accessory has an attachment device which fastens inwardly around the cap's rear size-adjustment strap. This is a somewhat complicated process, and one which is also likely to catch and entangle the hair of the wearer, especially if the attachment device is a Velcro hook and loop fasteners, as is described. There is a separate size-adjustment mechanism for the accessory, necessitating at least two operations for affixation. Furthermore, this accessory also does not protect the forward areas of the face.

OBJECTS AND ADVANTAGES

Accordingly, several objects and advantages of the present invention are:

(a) to provide a headgear accessory capable of protecting the wearer's face—including cheeks, nose, chin, and jaw—as well as the ears and neck, from oblique sunlight.

(b) to provide a headgear accessory capable of protecting these areas from cold and wind.

(c) to provide a headgear accessory that will be useful to men, women, and children.

(d) to provide a headgear accessory that can be used with a wide range of headgear, including hats, caps and visors.

(e) to provide a headgear accessory that, in the absence of a piece of headgear, can also be worn by itself.

(f) to provide a headgear accessory that can be easily and quickly attached, removed, and replaced.

(g) to provide a headgear accessory that is adjustable in size.

(h) to provide a headgear accessory that requires only one operation for affixing and adjusting onto differently sized headgear.

(i) to provide a headgear accessory that is simple and economical to manufacture.

(j) to provide a headgear accessory that is useful in many different weather conditions.

(k) to provide a headgear accessory that has no parts or attachments that are likely to catch or entangle the hair of the wearer.

(l) to provide a headgear accessory that can be easily carried in a purse or pocket.

(m) to provide a headgear accessory that is capable of shielding the eyes of a wearer from glare and excess UV radiation, thereby reducing the need for sunglasses.

(n) to provide a practical alternative to sunscreen lotions for those who dislike or are allergic to such products.

(o) to augment the effectiveness of sunscreen lotions, especially under conditions where their effectiveness is limited, such as under conditions of extended sun exposure or heavy exertion.

A further object and advantage is to provide a headgear accessory that has various optional methods of deployment, in response to changes in weather conditions and the angle and direction of the sun. Still further objects and advantages will become apparent from a consideration of the ensuing description and drawings.

BRIEF DESCRIPTION OF DRAWINGS

FIG. 1 is a perspective view of a preferred embodiment of the present invention.

FIG. 2 is a side view of the accessory shown in FIG. 1, here shown attached to a brimmed hat on a wearer.

FIG. 3 is a side view of the accessory shown in FIG. 1 with the accessory shown attached to a visored cap on a wearer.

FIG. 4 is a side view of the accessory shown in FIG. 1, here shown attached to a sunvisor on a wearer.

FIG. 7 (shown with FIGS. 1–4) is a detailed view of the rear affixation/size-adjustment mechanism of the accessory shown in FIG. 1.

FIGS. 10*a*–10*g* show various optional methods of deployment.

REFERENCE NUMERALS IN DRAWINGS

Figure 5:
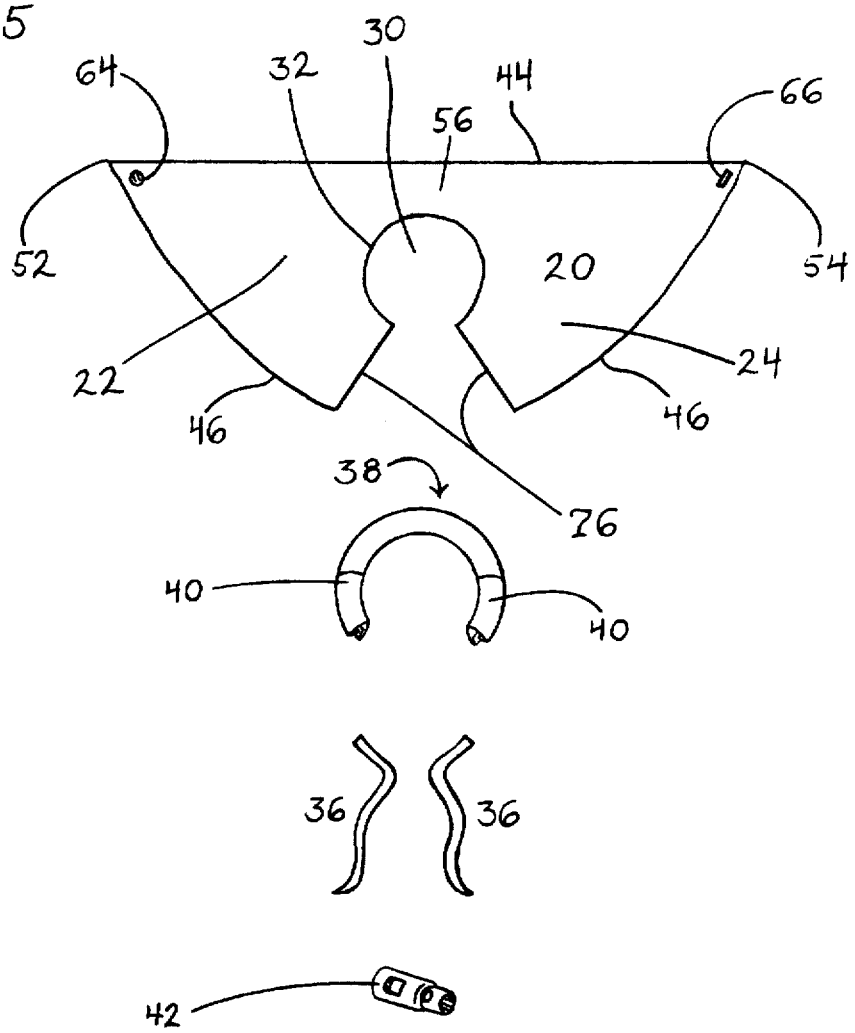
FIG. 5 is a top flat view of the accessory shown in FIG. 1 before assembly.

22 body portion
22 left half
24 right half
26 inner surface
28 outer surface
30 inner opening
32 inner edge
34 affixation and size-adjustment mechanism
36 drawstrings
38 bias tape trim/finishing
40 casings
42 cord-stop mechanism, toggle
44 front edge
46 lower edge
48 left lower edge
50 right lower edge
52 left corner
54 right corner
56 visor-covering area
58 hold-back mechanism
60 inner hold-back strap
62 outer hold-back strap
64 button
66 buttonhole
68 ties
70 buckle fastener
76 seam
78 left inner edge corner
80 right inner edge corner
82 encircling affixation/size adjustment mechanism

DETAILED DESCRIPTION OF DRAWINGS—FIRST EMBODIMENT

The first embodiment of the weather-shielding headgear-accessory, as shown in FIGS. 1–7, includes a body portion 20 formed from a flexible, planar piece of material. In the preferred embodiments this material is a fairly strong, breathable, somewhat opaque, woven fabric such as cotton, cotton blends, rayon, linen, etc. However many other materials may be used so long as they are flexible and somewhat opaque.

The headgear-accessory has an inner opening 30 approximately circular in shape, and large enough to fit over and around the crown of a piece of headgear; an inner edge 32 defining inner opening 30; and an affixation and size-adjustment mechanism 34 located on inner edge 32. In the first and preferred embodiment, as shown in FIGS. 1 and 7, mechanism 34 is located toward the rear of inner edge 32 and consists of two drawstrings 36 partially housed in complementary casings 40 and capable of being pulled through a cord-stop mechanism or toggle 42 thereby constricting or expanding the size of inner opening 30. (In this embodiment, casings 40 are formed from the two ends of a bias tape trim finishing 38 on inner edge 32.) The size of inner opening 30 can be adjusted to fit any head size from that of a small child to an extra-large adult.

Figure 11A:
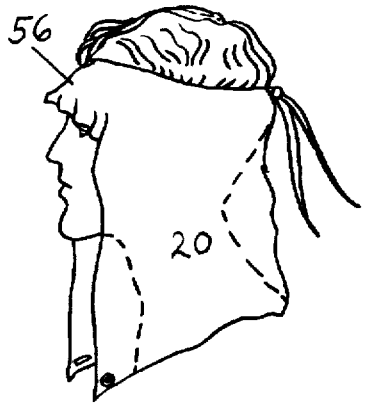
FIG. 11*a* is a side view of the first embodiment on a wearer in the absence of another piece of headgear.
Figure 11B:
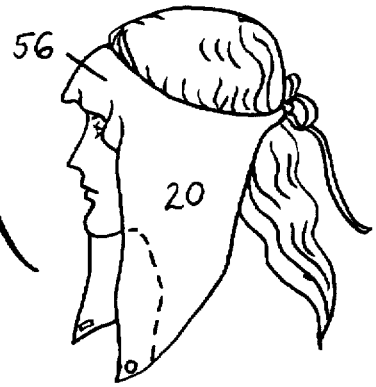
FIG. 11*b* is a side view of the second embodiment being worn in the absence of another piece of headgear.

Thus a wearer of a piece of headgear first positions inner opening 30 around the crown of a piece of headgear (or around the crown of the head itself when the accessory is to be worn alone, or with a sunvisor, as shown in FIGS. 11*a*, 11*b*, and 4), and then tightens drawstrings 36 by pulling them through cord-stop mechanism 42 until inner edge 32 is securely attached onto the crown of the headgear. In the absence of a cord-stop mechanism, drawstrings 36 can be tied together in the same manner as a shoelace.

Many other fastening methods are of course possible, for example straps with buckle fasteners 70 that allow for adjustment in strap length, such as Fastex brand buckle fasteners 70 (shown on a different embodiment in FIG. 12*c*), and elasticized elements (not shown).

Once the headgear-accessory has been fitted and secured onto a piece of headgear, it can be removed in one quick motion by tugging body portion 20 upwards with one hand while holding the brim of the headgear with the other hand. Likewise, the accessory can be replaced on the same or a similarly sized piece of headgear by positioning inner opening 30 over the crown and tugging downwardly with both hands on body portion 20 until inner edge 32 rests securely around the crown. Thus there is no need to re-adjust mechanism 34 each time the accessory is removed from, or replaced onto a piece of headgear.

Figure 6:
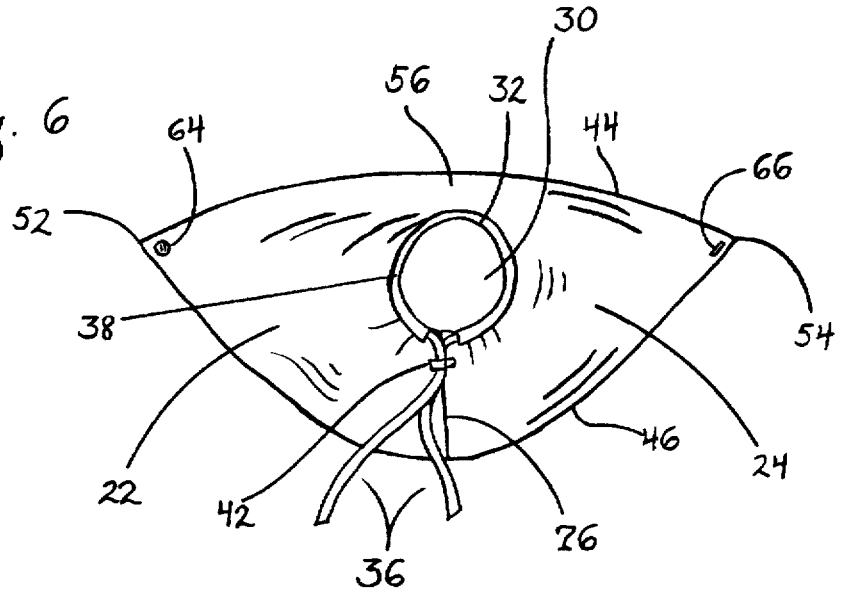
FIG. 6 is a top flat view of the accessory shown in FIG. 1 fully assembled.

In the first and preferred embodiment, body portion 20 extends skirt-style around the back of the wearer's neck such that a lower edge 46 forms one continuous edge from a left corner 52 to a right corner 54. A left half 22 and a right half 24 of body portion 20 are joined by a seam 76 at the rear of body portion 20, as shown in FIGS. 5 and 6. Referring again to FIGS. 5 and 6, it can be seen that body portion 20 is shaped so as to flare slightly outward from inner edge 32 to lower edge 46, thus allowing for cooling airflow and ventilation as well as ease of movement. This also allows the accessory to drape comfortably over the shoulders and upper back of the wearer in the case of a longer accessory or a shorter wearer.

Referring to FIGS. 2 and 3 it can be seen that the accessory has a visor-covering area 56 between a front edge 44 and inner opening 30. When worn over a piece of headgear, visor-covering area 56 lies over the visor (FIG. 3) or the forward extension of the brim of the headgear (FIG. 2), thereby extending front edge 44 forward of the wearer's face. In this position, body portion 20 extends downwardly from both sides of the visor (or the forward extension of the brim) to an area below the wearer's chin, thereby entirely shielding both sides of the wearer's face from oblique sunlight.

Visor-coveting area 56 can be rolled or folded back by the wearer when less sun protection is needed, as shown in FIG. 10*a*. In one embodiment of this accessory, a visor area hold-back mechanism 58 is provided as shown in FIGS. 1 and 10*b*. Hold-back mechanism 58 (as shown in FIG. 1) consists of two pairs of small hold-back straps or ties 60 and 62. Hold-back mechanism 58 is affixed proximate inner edge 32 of visor-covering area 56. One strap 62 of each pair is affixed to an outer surface 28 of the accessory and the other strap 60 affixed to an inner surface 26. When inner and outer straps 60 and 62 of a pair are tied or otherwise fastened together over front edge 44, visor-covering area 56 is constricted back to whatever position the wearer desires (FIG. 10*b*).

Referring to FIGS. 1, 5, and 6, it can be seen that front edge 44 meets lower edge 46 at left and right corners 52 and 54, forming two somewhat acute angles. A button 64 and buttonhole 66 are located at each corner 52 and 54 (FIG. 1), or either corner 52 and 54 (FIG. 6), enabling corners 52 and 54 to be buttoned together (FIGS. 10*d*, 10*e*). They can also be buttoned to the upper button and buttonhole of a wearer's shirt or blouse (FIG. 10*c*).

Referring now to FIGS. 10*a*–10*g*, the reader can see some of the optional methods of deployment of the present invention:

FIG. 10*d* shows the accessory buttoned together at left and right corners 52 and 54 thereby holding the accessory down over the sides of the face in the event of wind, while still allowing ventilation and airflow through the accessory.

FIG. 10*c* shows left and right corners 52 and 54 buttoned to the upper (unbuttoned) button and buttonhole of a wearer's shirt, allowing even more ventilation and airflow.

FIG. 10*f* shows left and right corners 52 and 54 tied snugly under the chin of the wearer in the case of cold or very windy weather.

FIGS. 10*a* and 10*b* show visor-covering area 56 and front edge 44 rolled back for less sun protection (or for a short brim).

FIG. 10*e* shows left and right corners 52 and 54 buttoned together behind the wearer's head, so that only the wearer's ears and back of neck are protected, when even less sun protection is required.

FIG. 10*g* shows one side of the accessory tucked up under the body of the headgear for those occasions when a wearer's head is fairly stationary in relation to the sun, and the sun is shining on the other side of the wearer. To do this, the wearer simply removes the headgear (with the accessory still attached), tucks one side of body portion 20 up inside the crown of the headgear, and replaces the headgear on his or her head. (Both sides of the accessory can be stored under the crown in this way as an alternative to buttoning corners 52 and 54 behind the head.)

Figure 11C:
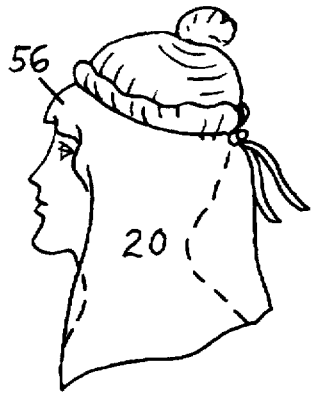
FIG. 11*c* is a side view of the first embodiment attached to a brimless cap on a wearer.

While the present invention is intended primarily to be used as an accessory to a piece of headgear with a brim or visor, it can be worn by itself if no other headgear is available, as shown in FIGS. 11*a* and 11*b*. In some cases this may be preferable to wearing it with a hat or cap, as when protection for the ears and neck is all that is desired. It can also be used to augment a brimless hat or cap, such as a stocking cap or skullcap, as shown in FIG. 11*c*. Worn in this way, visor-covering area 56 hangs over and shades the forehead and temples of the wearer, while the rest of body portion 20 hangs over and protects the cheekbones, rear areas of cheeks and jaw, the ears, and sides and back of neck.

DETAILED DESCRIPTION OF DRAWINGS—OTHER EMBODIMENTS

Figure 8:
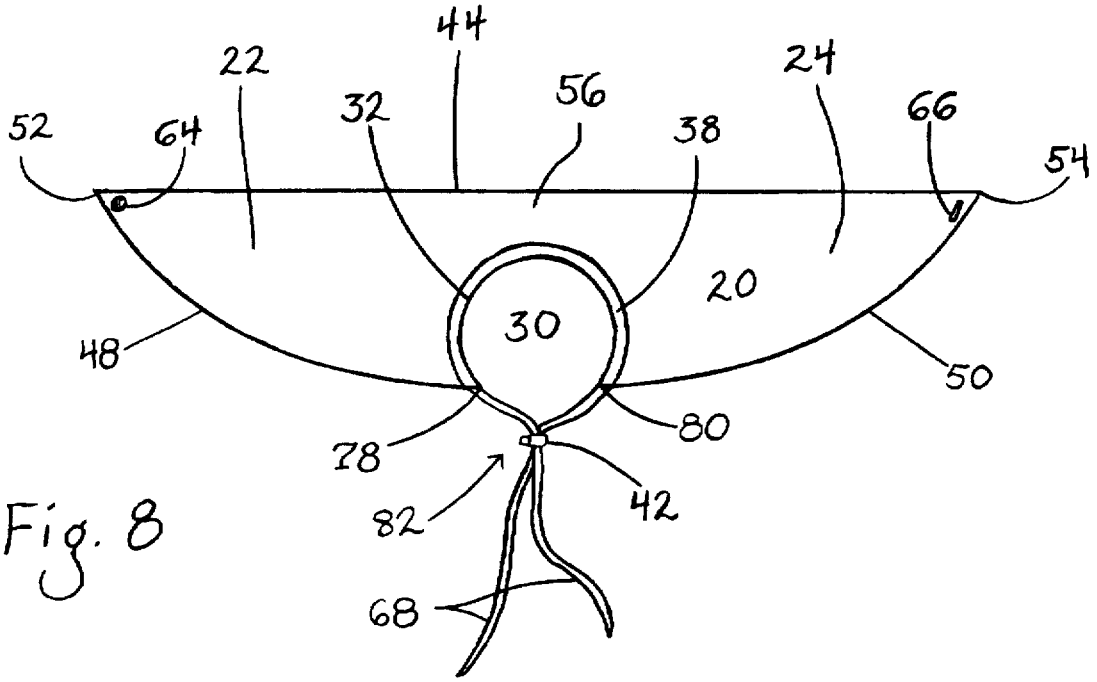
FIG. 8 is a top flat view of a second embodiment of the invention.
Figure 9:
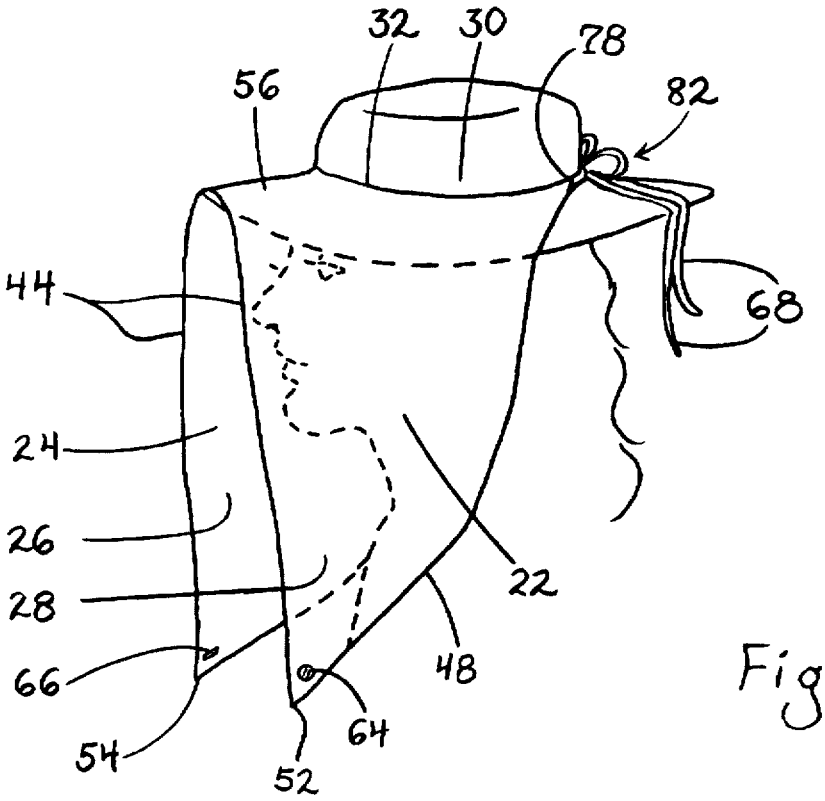
FIG. 9 is a perspective view of the second embodiment, shown attached to a brimmed hat on a wearer.

FIGS. 8 and 9 show a second embodiment of the present invention, for use by a wearer who does not need sun protection for the back of the neck. This could be a person who has long hair, or who already has a cap with dependent neck flaps, or a backpacker with a brimmed hat whose backpack shades the lower portion of the back of the neck. Such persons may prefer not to have extra coverage of the back of the neck, while still needing coverage for sides of face, neck and ears.

Referring to FIGS. 8 and 9, the reader will see that body portion 20 of the second embodiment does not extend skirt-style around the back of the wearer's neck. Instead, body portion 20 extends from front edge 44 only to a left and a right inner edge corner 78 and 80 located to the rear of a wearer's ears. This embodiment has two separate lower edges: a right lower edge 150 which extends from right corner 54 up to right inner edge corner 80, and a left lower edge 48 which extends from left corner 152 up to left inner edge corner 78. (Lower edges 48 and 150 may be straight, curved, or angled.) Inner edge corners 78 and 80 can be connected around the back of the head apron-style by an encircling affixation and size-adjustment mechanism 82, which here consists of a pair of ties 68 tied together in the same manner as a shoelace (FIG. 9), or fastened together by cord-stop mechanism 42 (FIG. 8). Ties 68 are either affixed to or are extensions of inner edge 32. As can be seen in FIG. 8, inner opening 30 of the second embodiment is circular in shape only when ties 68 are connected together. When ties 68 are not connected, inner opening 30 is an open semi-circle.

In all other respects than those listed above, the second embodiment of this accessory is almost identical to the first embodiment. For example, all of the various methods of deployment shown in FIGS. 10*a*–10*g* apply to the second embodiment as well as to the first.

Figure 12A:
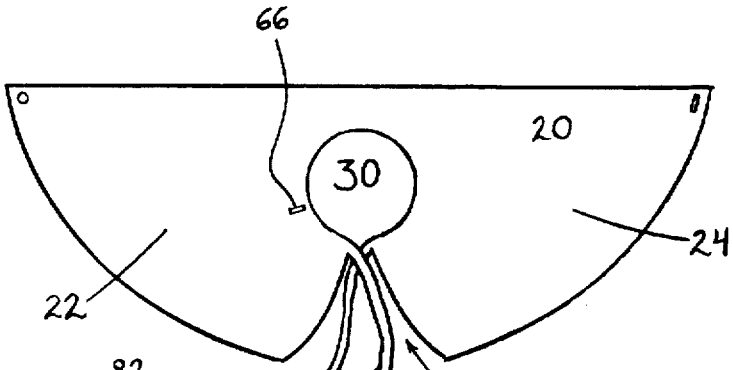
FIG. 12*a* is a top, flat view of a third embodiment.
Figure 12B:
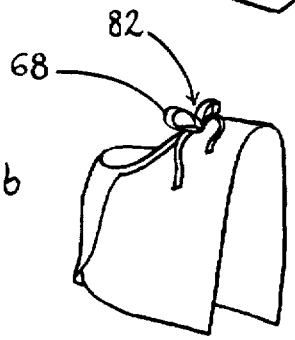
FIG. 12*b* is a side view of the third embodiment.
Figure 12C:
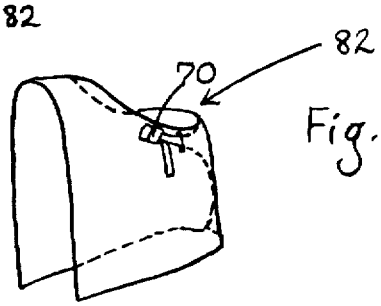
FIG. 12*c* is a side view of the third embodiment, showing an alternative closure method.

Other embodiments that fall under the scope of the present invention are of course possible. One such embodiment is a "wrap-around-skirt" version of the accessory, shown in FIGS. 12*a*–12*c*. This embodiment has no rear seam. The two halves 22 and 24 remain separated at the rear of body portion 20, and, when worn, overlap one onto the other and are pulled around to the opposite sides in the manner of a wrap-around skirt. The overlapping sides are fastened either at the sides of the accessory (FIG. 12*c*), or at the front of the accessory (FIG. 12*b*), proximate inner edge 32. Encircling affixation and size-adjustment mechanism 82 can be a pair of ties 68 (FIGS. 12*a* and 12*b*), with or without cord-stop mechanism 4.2, or straps with buckles 70 that allow for adjustment in strap length, such as Fastex brand buckle fasteners 70 (FIG. 12*c*), or many other fastening methods. Referring to FIG. 12*a* it can be seen that the overlapping half of the accessory has a buttonhole (or similarly sized opening) 66 close to inner opening 30 to allow tie 68 of the underlapping half to pass through and be fastened on outer surface 28.

Figure 13:
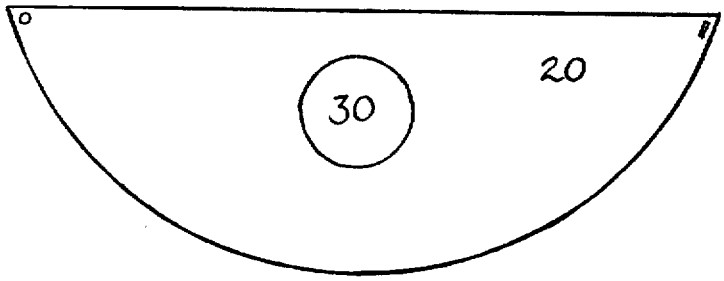
FIG. 13 is a top, flat view of the body portion of a fourth embodiment.

Another possible embodiment is a "circle skirt" version, as shown in FIG. 13. This version has no seam. Body portion 20 is cut as one continuous piece on a flat plane, with an inner opening 30. This results in an even more flared body portion than in the first and preferred embodiment.

SUMMARY, RAMIFICATIONS, AND SCOPE

Accordingly, the reader will see that this weather-shielding headgear accessory solves an apparently hitherto unrecognized problem:—how to shield the forward areas of the face from oblique sunlight.

The Dangers of Over-exposure to the Sun: These dangers are now widely known. Repeated sunburns and even excessive tanning are known to cause premature wrinkling and skin cancer. Furthermore, there is evidence of a world-wide increase in ultra-violet radiation from the sun as a result of the depletion of the ozone layer in the upper atmosphere. People are much more concerned about shielding themselves from the harmful effects of the sun now than they have been in the past, as can be seen from the increase in consumption of sunscreening products relative to suntanning products.

Limitations of Sunscreen Lotions: Sunscreen lotions, while useful, have many limitations. For maximum effectiveness they must be applied liberally, and be continually reapplied during extended sun-exposure. Many find this to be messy and inconvenient. These products also tend to lose their effectiveness during heavy exercise, as perspiration gradually washes them off. Furthermore, many people are either allergic to them or dislike the way they feel, and are therefore reluctant to use them. Still others are worried about the possibility of adverse side effects from repeated use of these products.

Vulnerability of Facial Areas: Because facial areas are not protected from the sun by clothing, and can only be partially protected by hats, they are particularly vulnerable, as anyone who has spent a whole day in bright sunshine knows.

Problem Finally Addressed: Until now, all attempts to increase the effectiveness of hats and caps in providing sun-protection have focussed on shielding only the neck and ears. The problem of protecting the face from oblique sunlight (as well as from wind and cold) has been ignored. The weather-shielding accessory of the present invention addresses and solves this problem. Furthermore, it does so in a way that is simple, convenient, aesthetically pleasing, and easily modifiable in response to differing needs.

The present invention also improves upon prior art solutions to the problem of shielding the ears and neck. It does so in simplicity of form, ease of use, and range of use.

Range of Use: This headgear accessory can be used with a wider range of possible headgear types (including no headgear) than any previously described accessory. These include brimmed hats, sunvisors, and visored caps (with or without rear size-adjustment straps). It can also be used to good effect on headgear without brims or visors, such as stocking caps, etc., and can even be worn by itself on the user's head in the absence of another piece of headgear. It can be adjusted to fit onto a wide range of sizes of heads and headgear, from small children's sizes to extra-large adult sizes.

Ease of Use: This headgear accessory is much easier to put on, remove, and replace than any previously described headgear accessory. It requires only one simple tightening procedure to initially adjust and attach it to a piece of headgear, whereas most previously known accessories require at least two or three much more complex operations for initial affixation. Furthermore, once the initial tightening has been done, the accessory can be removed and replaced on the same (or a similarly sized) piece of headgear without further adjustments. Thus it is much easier for a wearer to take off and replace than are other accessories.

This is especially important for recreational users and others who may go back and forth between sunny and shady conditions, or indoors and outdoors. Such a user may not wish to be hampered by an accessory when it is not necessary, yet may be reluctant to spend a lot of time detaching and re-attaching a complex accessory, even if he or she is concerned about sun exposure. Thus, the easier the accessory is to remove and replace, the more likely that it will actually be used.

This accessory has no attached parts that are likely to fall off and get lost, or become entangled in the hair of a wearer. It is easy to care for, cannot be damaged by being crushed or sat upon, and fits easily into a purse or pocket (or inside the crown of a hat) when not needed.

Simplicity of Form: This accessory has one unitary body portion and one affixation/size-adjustment mechanism. It has no clips or other attachments that are integral to its basic form. Thus it is easier to manufacture and to use than previously known accessories.

In addition, this headgear accessory can obviate or reduce the need for sunglasses. It can also reduce the need for, or augment the effectiveness of sunscreen lotions. Thus it is especially beneficial to those persons with allergies to sunscreen lotions, and those who are in the sun for extended periods of time, such as backpackers, agricultural workers, outdoor sports fans, and all others whose jobs or recreational activities result in extended sun exposure.

Although the description above contains many specificities, these should not be construed as limiting the scope of the invention, but as merely providing illustrations of some of the presently preferred embodiments of this invention. For example, the edges may be finished in any way desired-hemmed, edged with bias tape or other finishings, stitched fast, or left untrimmed, etc. The body portion of the accessory can have different proportions than those described: it can be longer or shorter than shown above; it can be shorter under the chin and hang down longer over the back of a wearer; it can be cut so as to flare less or more than has been described; it can be cut to hang in two long strips on either side of the head, in the manner of a long sash, etc. The front corners can be rounded, and the lower edge scalloped or fringed. The visor-covering area can be made longer or shorter than has been described by having the front edge cut further from or closer to the inner edge. The visor-covering area can have various methods for being held back other than the hold-back mechanism that has been described. The affixation/size adjustment mechanism can have different components and be simpler or more complex than the examples given. For example, one drawstring in one casing might be used, completely encircling the inner edge, with the two ends of the drawstring being pulled through a cord-stop mechanism or tied. The left and right corners may have other fasteners than those described, or have no fasteners.

The accessory can also be used in other ways than those described. For example, the front corners can be tied rather than buttoned behind the wearer's head. In the absence of another piece of headgear, this accessory can be worn under the hair of the wearer, with the bangs and hair hanging freely down over the accessory. Or, worn in this way, the two corners of the accessory can be tied back behind the head or neck in the manner of a bandana, covering and protecting the hair of the wearer.

Thus the scope of the present invention should be determined by the appended claims and their legal equivalents, rather than by the examples given.

I claim:

1. A weather-shielding accessory for headgear, comprising:

(a) a body portion of a flexible, planar, material, having some degree of opacity, an inner surface and an outer surface, one single, unitary, and substantially straight front edge, a left half and a right half of predetermined proportions;

(b) an inner opening large enough to encircle the crown of a piece of headgear, and an inner edge defining said inner opening;

(c) an affixation and size-adjustment means located proximate said inner edge, wherein when said weather-shielding accessory for headgear is located on a piece of headgear, said affixation and size-adjustment means functions to removably attach the accessory around the crown of the headgear, and is capable of adjusting the accessory to fit onto differently sized pieces of headgear;

(d) a unitary visor-covering area located between the front edge and said inner opening, wherein when the accessory is located on a piece of headgear that includes a forwardly extending portion selected from the group consisting of brims and visors, said visor-covering area is capable of draping across the forward extension of such a piece of headgear without extending beyond such a forward extension, thereby extending the front edge of said body portion forward of a wearer's cheekbones, such that said body portion is capable of extending downwardly from the lower and outer edges of the headgear along the sides and back of a wearer's head and neck, starting from both sides of the forward extension of the headgear, and continuing along the sides and rear of the lower edge of the headgear, thereby shielding a wearer's neck, ears, and sides of face from adverse weather conditions including sun, cold, and wind, while not impeding the forward vision of a wearer, (e) a pair of drawstrings, partially housed in complementary casings located proximate said inner edge of said body portion, said pair of drawstrings each having one freehanging end capable of being adjustably fastened together in a plurality of positions.

2. The weather-shielding accessory for headgear of claim 1, further including a fastening means located at a lower left corner and a lower right corner of the front edge, enabling said lower left corner and said lower right corner to be releasably fastened together.

3. The weather-shielding accessory for headgear of claim 2, wherein said fastening means comprises a predetermined number of buttons and buttonholes.

4. The weather-shielding accessory for headgear of claim 1, further including a fastening means located at a lower left corner and a lower right corner of the front edge, enabling the lower left and right corners to be releasably fastened to a wearer's shirt.

5. The weather-shielding accessory for headgear of claim 4, wherein said fastening means comprises a predetermined number of buttons and buttonholes.

6. A weather-shielding accessory for headgear, comprising:

(a) a body portion of a flexible, planar, material, having some degree of opacity, an inner surface and an outer surface, one single, unitary, and substantially straight front edge, a left half and a right half of predetermined proportions;

(b) an inner opening large enough to encircle the crown of a piece of headgear, and an inner edge defining said inner opening;

(c) an affixation and size-adjustment means located proximate said inner edge, wherein when said weather-shielding accessory for headgear is located on a piece of headgear, said affixation and size-adjustment means functions to removably attach the accessory around the crown of the headgear, and is capable of adjusting the accessory to fit onto differently sized pieces of headgear;

(d) a unitary visor-covering area located between the front edge and said inner opening, wherein when the accessory is located on a piece of headgear that includes a forwardly extending portion selected from the group consisting of brims and visors, said visor-covering area is capable of draping across the forward extension of such a piece of headgear without extending beyond the front edge of such a forward extension, thereby extending the front edge of said body portion forward of a wearer's cheekbones, such that said body portion is capable of extending downwardly from the lower and outer edges of the headgear along the sides and back of a wearer's head and neck, starting from both sides of the forward extension of the headgear, and continuing along the sides and rear of the lower edge of the headgear, thereby shielding a wearer's neck, ears, and sides of face from adverse weather conditions including sun, cold, and wind, while not impeding the forward vision of a wearer, (e) a fastening means located at a lower left corner and a lower right corner of the front edge, enabling the lower left and right corners to be releasably fastened to a wearer's shirt.

7. The weather-shielding accessory of claim 6, wherein said fastening means comprises a predetermined number of buttons and buttonholes.

8. The weather-shielding accessory of claim 6, wherein said fastening means located at said lower left corner and said lower right corner of the front edge, enables said lower left corner and said lower right corner to be releasably fastened together.

9. The weather-shielding accessory of claim 8, wherein said fastening means comprises a predetermined number of buttons and buttonholes.

10. The weather-shielding accessory of claim 6, wherein said affixation and size-adjustment means comprises a drawstring partially housed in a casing located proximate said inner edge, said drawstring having two freehanging ends capable of being pulled through said casing and adjustably fastened together in a plurality of positions.

11. The weather-shielding accessory of claim 6, wherein said affixation and size-adjustment means comprises a pair of drawstrings, partially housed in complementary casings located proximate said inner edge of said body portion, said pair of drawstrings each having one freehanging end capable of being adjustably fastened together in a plurality of positions.

12. A piece of headgear and a removable weather-shielding accessory for headgear, comprising: a piece of headgear that includes a crown and a forwardly extending portion selected from the group consisting of brims and visors; and a weather-shielding accessory for headgear comprising:

(a) a body portion of a flexible, planar material, having some degree of opacity, an inner surface and an outer surface, a substantially straight front edge, a left half and a right half of predetermined proportions;

(b) an inner opening of a predetermined shape, minimally large enough to encircle the crown of a wearer's head, and an inner edge defining said inner opening;

(c) an affixation and size-adjustment means located proximate said inner edge, wherein when said piece of headgear and said weather-shielding accessory for headgear are conjunctively located on a wearer's head, said affixation and size-adjustment means is capable of removably attaching the accessory around the conjoined circumference of a wearer's head and the headgear, and is capable of adjusting the accessory to fit onto a plurality of sizes of heads and headgear;

(d) a visor-covering area located between the front edge and said inner opening, wherein when the inner edge of the accessory is fitted about the crown of the headgear, said visor-covering area is capable of draping across said forwardly extending portion of the headgear without extending beyond said forwardly extending portion, and is thereby capable of extending the front edge of said body portion forward of a wearer's cheekbones, such that said body portion is capable of extending downwardly from the headgear along the sides of a wearer's face, thereby shielding a wearer's face from adverse weather conditions including sun, cold, and wind, while not impeding the forward vision of a wearer.

13. The piece of headgear and weather-shielding accessory for headgear of claim 12, wherein said body portion of the accessory is capable of extending downwardly from the headgear around the sides and back of a wearer's head, whereby a wearer's ears and sides and back of a wearer's neck are shielded from adverse weather conditions including sun, cold, and wind.

14. The piece of headgear and weather-shielding accessory for headgear of claim 12, wherein said affixation and size-adjustment means comprises a drawstring partially housed in a casing located proximate said inner edge, said drawstring having two freehanging ends capable of being pulled through said casing and fastened together in a plurality of positions.

15. The piece of headgear and weather-shielding accessory for headgear of claim 14, further including a cord-stop mechanism through which the ends of said drawstring are capable of being threaded and adjustably held fast in a plurality of positions.

16. The piece of headgear and weather-shielding accessory for headgear of claim 12, wherein said affixation and size-adjustment means comprises a pair of drawstrings, partially housed in complementary casings located proximate said inner edge of said body portion, said pair of drawstrings each having one freehanging end capable of being fastened together in a plurality of positions.

17. The piece of headgear and weather-shielding accessory for headgear of claim 16, further including a cord-stop mechanism through which the drawstrings are capable of being threaded and adjustably held fast in a plurality of positions.

18. The piece of headgear and weather-shielding accessory for headgear of claim 12, further including a fastening means located at a lower left corner and a lower right corner of the front edge, enabling said lower left corner and said lower right corner to be releasably fastened together.

19. The piece of headgear and weather-shielding accessory for headgear of claim 18, wherein said fastening means comprises a predetermined number of buttons and buttonholes.

20. The piece of headgear and weather-shielding accessory for headgear of claim 12, further including a fastening means located at a lower left corner and a lower right corner of the front edge, enabling the lower left and right corners to be releasably fastened to a wearer's shirt.

21. The piece of headgear and weather-shielding accessory for headgear of claim 20, wherein said fastening means comprises a predetermined number of buttons and buttonholes.

* * * * *